US005548497A

United States Patent [19]

Cho

[11] Patent Number: 5,548,497

[45] Date of Patent: Aug. 20, 1996

[54] RECESSED LIGHTING FIXTURE

[75] Inventor: Hyung R. Cho, Seoul, Rep. of Korea

[73] Assignee: Il Sung Moolsan Co., Ltd., Seoul, Rep. of Korea

[21] Appl. No.: 383,501

[22] Filed: Feb. 3, 1995

[51] Int. Cl.[6] ..... F21S 3/02

[52] U.S. Cl. ..... 362/260; 362/294; 362/364

[58] Field of Search ..... 362/364, 260, 362/265, 148, 150, 217, 218, 365, 294, 373, 147, 368

[56] References Cited

U.S. PATENT DOCUMENTS

| | | | |
|---|---|---|---|
| 2,648,764 | 8/1953 | Kirlin | 362/294 |
| 3,459,934 | 8/1969 | Moore | 362/294 |
| 3,883,732 | 5/1975 | Peterson | 362/294 |
| 4,104,713 | 8/1978 | Chan | 362/294 |
| 4,302,798 | 11/1981 | Sit | 362/373 X |
| 4,507,719 | 3/1985 | Quiogue | 362/373 X |
| 5,016,151 | 5/1991 | Mula | 362/294 |
| 5,136,493 | 8/1992 | Straus | 362/373 |
| 5,398,179 | 3/1995 | Pacheco | 362/364 |

*Primary Examiner*—Denise L. Gromada
*Assistant Examiner*—Thomas M. Sember
*Attorney, Agent, or Firm*—Kennedy & Kennedy

[57] ABSTRACT

A recessed lighting fixture having a socket for receiving a lamp which generates light for emitting through an opening in the fixture. The socket connects to electrical conductors that communicate through a ballast with a supply of electricity. An insulative bag encloses the ballast and a banding tape seals an opening of the bag around the ballast for restricting communication of heat from the lamp to the ballast during operation of the lamp. A deflector plate disposed between the socket and the ballast further blocks communication of the heat to the ballast. A method of restricting thermal communication with the ballast is disclosed.

15 Claims, 2 Drawing Sheets

RECESSED LIGHTING FIXTURE

TECHNICAL FIELD

The present invention relates to recessed lighting fixtures. More particularly, the present invention relates to an apparatus and method for restricting thermal communication to ballasts that operate lamps in recessed lighting fixtures.

BACKGROUND OF THE INVENTION

Recessed lighting fixtures are one of the various types of lighting fixtures used to provide light for rooms, such as in homes or offices. Recessed lighting fixtures typically mount in a space over a ceiling so that the fixture is not readily seen in a room. The light from the fixture passes through an opening in the ceiling into the room. Such fixtures provide light that not only brightens rooms, but provides artistic qualities to the lighting scheme. Recessed lighting fixtures accordingly maintain the fixture out of view, typically above a ceiling, while lighting a room.

Known recessed lighting fixtures typically have a frame that connects to a support in the space over the ceiling. A reflector having an open end extends upwardly from an opening in the frame. A socket or lamp holder mounts at an upper end of the reflector for receiving a light bulb. The interior surfaces of the reflector direct the light from the bulb to the room below the ceiling. The socket includes electrical conductors which communicate with a supply of electrical current, preferably through a conventional junction box. Recessed lighting fixtures generally use fluorescent light bulbs which require electrical devices known as ballasts that stabilize the supply of current to the light bulb. A housing typically mounts to the frame as an enclosure for the fixture. The ballast mounts to an interior surface of the housing spaced apart from a sidewall of the reflector.

During operation of the lighting fixture, the fluorescent light bulb generates both light and heat. The light passes through the opening in the fixture to the room below. The heat preferably passes into the room. However, some heat is communicated to the housing and to the ballast. The heat degrades the performance of the ballast and excessive temperatures can damage the ballast. The temperature of the surface of the housing also is increased. The housing for recessed lighting fixtures typically is overly large so as to provide an air space between the ballast and the lamp. The air absorbs a portion of the heat and helps distribute the heat to avoid localized heating of a portion of the housing. However, large housings have drawbacks in requiring more materials and labor to manufacture and limiting the space in which the fixtures may be installed.

The location of the recessed lighting fixture and the generation of heat during operation of the fixture pose problems that affect the use of such fixtures. Typically, access to the space over a ceiling is restricted and access may require removal of ceiling materials. Monitoring and observation of the fixture for operating problems and for maintenance is therefore difficult. Replacement of a damaged or inoperative ballast, for instance, may require removal and reinstallation of plasterboard sheeting of which some ceiling are made. The excessive temperatures may damage the electrical conductors carrying electrical current to the lamp. Damaged wires may fail. Also, insulative materials are often placed in the spaces above ceilings, including being placed around and over the recessed lighting fixture. These materials may contact the sides of the housing. Increased temperatures may damage the insulative materials. Such problems present risk of damage to property and injury to persons.

Accordingly, there is a need in the art for smaller recessed lighting fixtures which reduce the risk of thermal damage to ballasts that operate lamps in such fixtures.

SUMMARY OF THE INVENTION

The present invention provides an improved, small recessed lighting fixture with a thermally protected ballast for operating a fluorescent lamp. The recessed lighting fixture installs in a space over a ceiling with an opening in one end of the fixture for passage of light emitted by the lamp held in the fixture. A socket attaches to a housing for receiving a fluorescent lamp. The socket communicates with a supply of electricity through the ballast which has sides, a support tab at a first end, and a distal end. The ballast provides resistance for stabilizing the electrical current to the lamp received in the socket. The improvement provides an insulative casing that enwraps the ballast to provide protection from being overheated by the lamp. In a preferred embodiment, an insulative bag having an open end is slidingly received on the ballast to blanket the sides and the distal end of the ballast. A banding tape wraps tightly around the open end of the insulative bag adjacent the first end of the ballast. The band substantially closes the open end of the bag to insulate the ballast from thermal communication with the lamp. In a preferred embodiment, the insulative bag comprises a layer of fiberglass fibers and a cover of a metallic foil. In an alternate embodiment the insulative casing comprises an open-ended rigid-wall container. Insulative material fills a gap between the ballast and the sides of the container. In another alternate embodiment the insulative casing comprises an epoxy blanket. The recessed lighting fixture further comprises a plate disposed between the socket and the ballast to deflect communication of heat from the lamp to the ballast. The plate includes a flange at one end that rigidly attaches to the housing. A sidewall extending from the flange provides a deflection barrier between the lamp and the ballast.

The present invention further provides a method of reducing thermal communication from a lamp to a ballast in a small recessed lighting fixture for installation in a space over a ceiling. The method comprises enclosing a ballast with an insulative casing. In a preferred embodiment, the casing comprises a closable insulative bag. An open end of the bag slidingly covers sides and a distal end of the ballast. A banding tape wraps tightly around the open end of the bag to substantially close the opening of the bag. In an alternate embodiment the ballast is inserted into a rigid-wall container which is then filled with an insulative fill material. Another alternate embodiment coats the ballast with an epoxy. The wrapped ballast is rigidly mounted in the housing spaced apart from the socket for receiving a lamp that generates light for emitting through an open end of the housing into a space below a ceiling. The ballast, being blanketed within the substantially closed insulative bag, does not become excessively heated by thermal communication with heat generated by the lamp during operation of the lighting fixture. The method further blocks heat generated by the lamp from being communicated readily to the ballast by a deflection plate disposed between the lamp and the ballast.

DETAILED DESCRIPTION OF THE PREFERRED EMBODIMENTS

Figure 1:
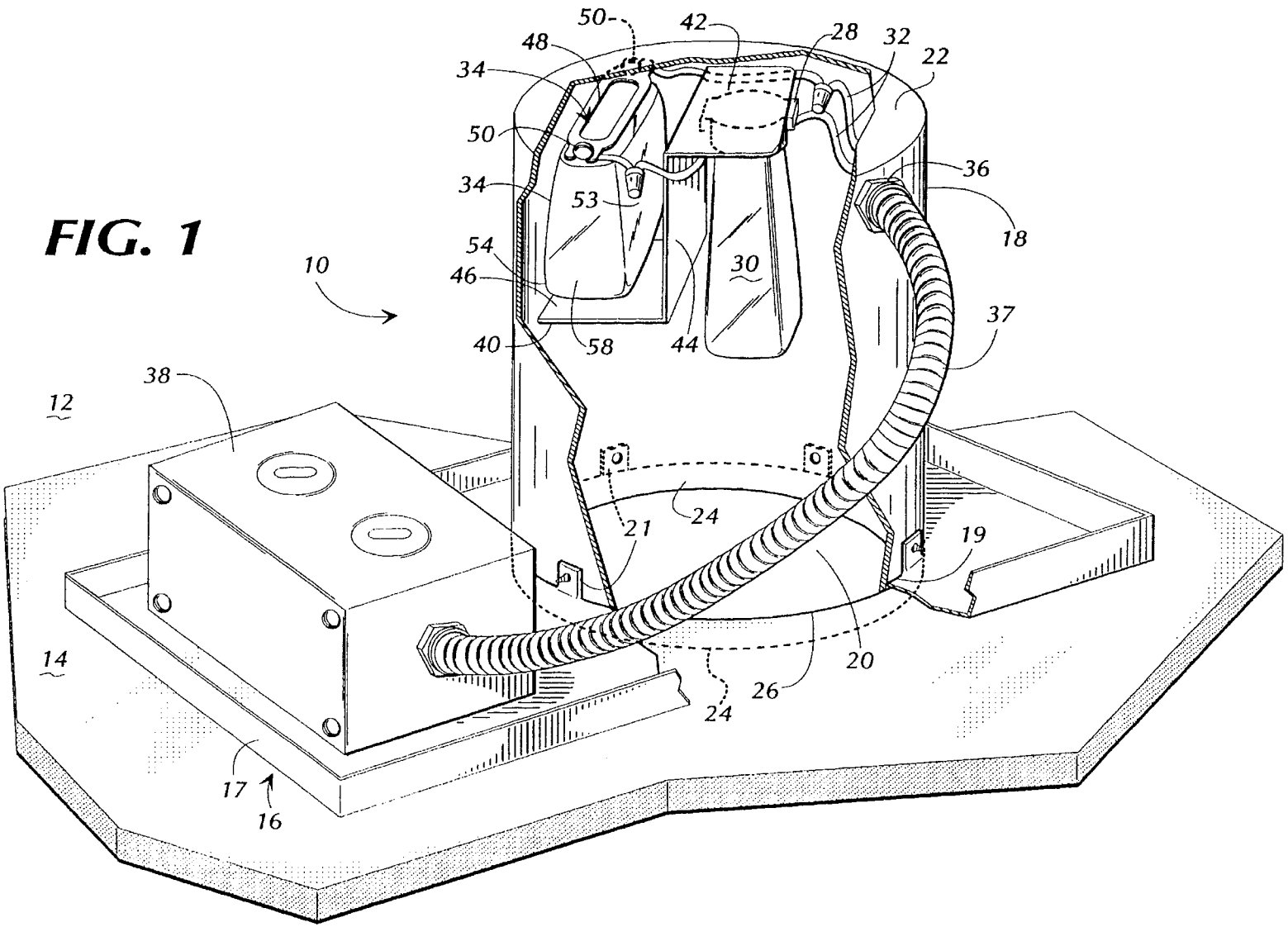
FIG. 1 is a perspective cut-away view of a recessed lighting fixture for installation in a space above a ceiling.

Referring now in more detail to the drawings, in which like numerals indicate like parts throughout the several views, FIG. 1 is a perspective view of a recessed lighting fixture 10 for installation in a space 12 above a ceiling 14. The fixture 10 includes a base 16 that supports the fixture above the ceiling 14. In the illustrated embodiment, the base 16 is a rectangular panel of sheet metal having upwardly extending flanges 17 around the sides for rigidity. A can 18 rigidly mounts in an opening 19 in the base 16. In the illustrated embodiment, the can 18 is cylindrical. The can 18 has an open end 20 and a closed end 22. The can 18 defines a housing for enclosing a lamp for the recessed lighting fixture, as discussed below. A plurality of tabs 21 extend upwardly from the base around the opening 19. Each tab 21 includes a bore through which a screw extends to secure the can 18 to the base 16. The base 16 is recessed with respect to the open end 20 of the can 18 to define a flange portion 24 on the can that extends laterally from the base. An opening 26 in the ceiling 14 receives the flange 24.

A socket 28 rigidly connects to the closed end 22 of the can 18. The socket 28 receives a lamp 30, which during operation of the fixture emits light through the open end 20 of the can 18 and through the opening 26 in the ceiling 14. The lamp 30 is fluorescent which uses a ballast 34 to stabilize the supply of current for operation of the lamp. A pair of electrical conductors 32 connect the socket 28 to a source of electricity (not illustrated) through the ballast 34. The electrical conductors 32 extend through a wire coupling 36 in a side wall of the can 18. The electrical conductors 32 are preferably disposed in conventional metal flex conduit 37 which connects with a conventional junction box 38 mounted on the base 16 for connecting with a source of electricity.

A plate 40 is disposed between the socket 28 and the ballast 34 to deflect heat away from the ballast. The plate 40 includes a flange 42 which rigidly attaches to the closed end 22 of the can 18. Conventional fasteners, such as screws or rivets, secure the flange 42 to the end 22. A first plate 44 depends from the flange 42. A second plate 46 extends at a perpendicular angle from the first plate towards the side of the can 18. In the illustrated embodiment, plate 40 is Z-shaped, although it could be substantially U-shaped.

Figure 2:
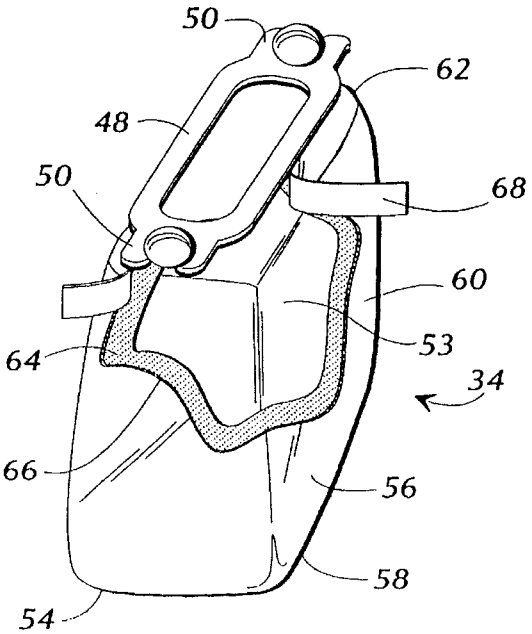
FIG. 2 is a perspective cut-away view of a ballast wrapped in an insulative bag for use in the lighting fixture illustrated in FIG. 1.

With reference to FIG. 2, the ballast 34 comprises a support end 48 having a pair of support tabs 50 extending outwardly from the ballast. Fasteners extend through the support tabs 50 to secure the ballast 34 to the closed end 22 of the can 18. The ballast 34 has sides 53 and a distal end 54. An insulative bag 56 wraps around the ballast 34. The insulative bag 56 has a closed bottom 58 and side walls 60 with an open end 62. The insulative bag 58 preferably comprises a layer of fiberglass fibers 64 and a thin cover 66. The cover 66 may be a film or sheet. In a preferred embodiment, the cover 66 is a metallic foil. A banding tape 68 wraps tightly around the open end 62 adjacent the support end 48 of the ballast 34. The banding tape 68 secures the insulative bag 56 to the ballast 34 and closes the open end 62 to restrict thermal communication to the ballast 34. In an alternate embodiment, the ballast is encased in an epoxy jacket.

Figure 3:
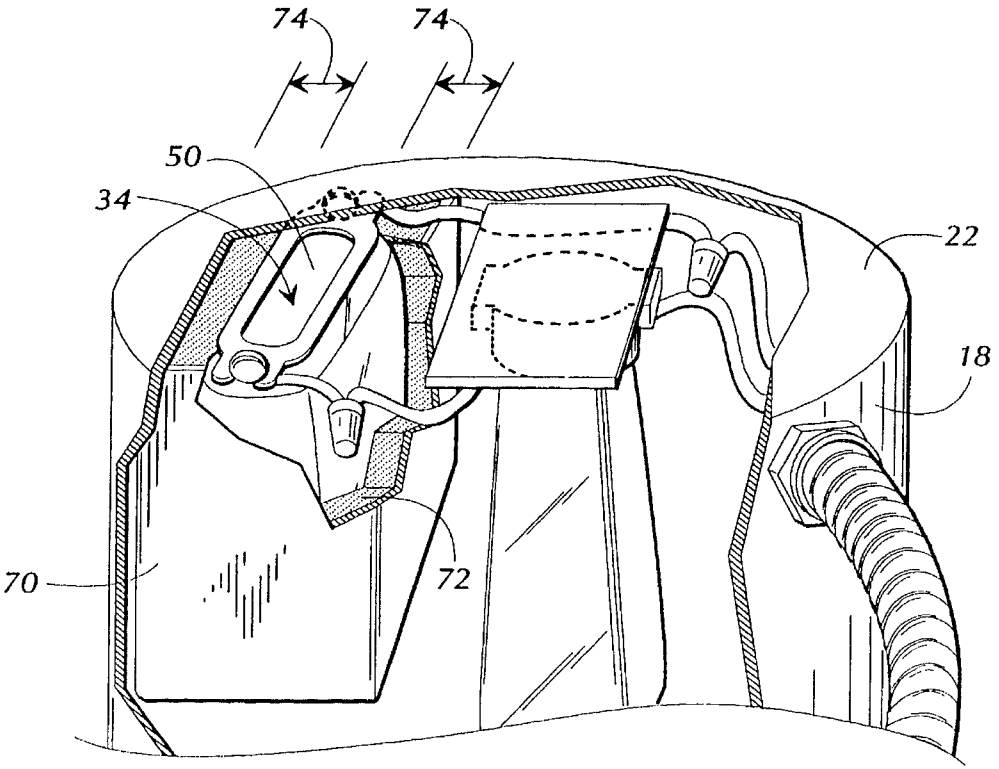
FIG. 3 is a perspective cut-away view of a ballast held in an insulative container for use in the lighting fixture illustrated in FIG. 1.

FIG. 3 is a perspective cut-away view of alternate embodiment for insulatively containing the ballast 34 in the can 18 that forms an enclosure for the fixture 10. The ballast 34 is received in an open-ended rigid-wall container 70 which is preferably made of plastic or metal. The ballast 34 is wedged into the container 70. In an alternate embodiment, adhesive or epoxy secures the ballast in the container 70. Insulative materials 72 fill in a gap portion 74 between the walls of the container 70 and the ballast 34. In a preferred embodiment, the fill material 72 is polyurethane foam. The fill material may be an epoxy, mats of fiberglass fibers, or the like. In an alternate embodiment (not illustrated), the container 70 includes outwardly projecting tabs that align with the support tabs 50 of the ballast 34. Rivets pass through the tabs for securing the container 70 and the ballast 34 to the end 22 of the can 18. The closed end 22 of the can 18 closes the container 70 when the ballast 34 is secured to the can.

The lighting fixture 10 is used to provide recessed lighting for a space below the ceiling 14. The opening 26 is cut in the sheetrock of the ceiling 14. The opening 26 is slightly larger than the perimeter of the can 18. The lighting fixture 10 is positioned on the sheetrock with the flange 24 of the can 18 extending through the opening 26 in the ceiling 14. Conventional fasteners (not illustrated) are used to secure the base 16 to the ceiling 14 or adjacent joists. The lamp 30 is inserted into the socket. The electrical conductors 32 in the junction box 38 are connected to a source of electricity (not illustrated).

During operation of the lighting fixture 10, electric current from the source of electricity is communicated though the ballast 34 to the lamp 30. The ballast becomes warm during operation. Light is emitted by the lamp 30 through the open end 20 and the opening 26 in the ceiling 14. The lamp 30 also generates heat. The heat from the lamp 30 is blocked by the plate 40 from being communicated readily to the ballast 34. Further, the heat generated by the lamp 30 is restricted from thermal communication to the ballast 34 by the insulative bag 56. The lighting fixture and method of the present invention accordingly permits lamps for recessed lighting fixtures to be held in smaller containers for installing in spaces over ceilings.

A fluorescent recessed lighting fixture was made in accordance with the present invention and tested for compliance with standard UL 1570 of Underwriters Laboratories, Inc. With reference to FIG. 1, the can 18 was made of 0.81 mm aluminum with a height of 18.7 cm and 15.2 cm diameter. The base 16 was made of galvanized steel having a thickness of 0.75 mm. The base 16 was 26.5 cm long and 18.5 cm wide. The electrical junction box 38 was a steel box having a length of 12.7 cm, a height of 8.25 cm and a width of 3.8 cm. The junction box was located 2.5 cm from the side of the can 18. The socket 28 was riveted to the top 22 of the can 18. The socket included integral electrical conductors suitable for a minimum temperature of 105° C. The plate 40 was secured to the top 22 of the can 18 by rivets. The plate 40 covered the ballast 34 which was a Class P Advance, catalog no. LO-13-22-TP. The insulative bag 56 provided Class B insulation. The ballast 34 was secured by rivets to the top 22 of the can 18 between the barrier plate 40 and the socket 28.

Thermocouples were attached to the lighting fixture to monitor temperatures during a test of the operation of the recessed lighting fixture. The locations of the thermocouples are listed in Table 2 below. The fixture was installed in a test box of one-half inch thick fir A–D grade plywood. The inside dimensions of the horizontal and vertical sides were such that the box was 8½ inches from the nearest points of the can 18 and the junction box 38. The back of the test box was in contact with the back of the fixture.

The recessed lighting fixture was connected to an appropriate supply of electrical voltage, as marked on the ballast. The through wires were routed using number 12 AWG-type THHN wires through the fixture outlet box, looping them such that twelve inches of each wire was in the outlet box 38. The wires were then routed out of the outlet box through electrical metal tubing or conduit. The conduit was projected 12 inches out of the test box and the through wires extended 4 inches out of the conduit, at both sides, and the ends of the conduit were plugged with cotton. The through wires were independently energized with a low voltage supply such that they continuously carried 16 amps. The current was rechecked after one hour of operation and readjusted to 16 amps, if necessary.

The test box was then completely filled with loose-fill cellulose insulation and the lamp was operated for a period of seven and one-half hours. Table 1 below reports the information about the lighting fixture used in the test.

Table 1—Lighting Fixture

Lamp Type/Wattage: Compact lamp/13 watts

Number of Through Wires: 4 in, 4 out

Test Box Inside Dimensions (inches): 27⅜×24¼×15⅝

Ballast: Advance, LO-13-22-TP

Trim: TM-19R

Ballast Voltage: 120 volts AC current

The maximum temperature obtained during the 7½ hour test period is reported on Table 2.

TABLE 2

| Maximum Temperature Obtained During 7½ Hour Test Period | |
|---|---|
| Thermocouple Location | Maximum Temperature °C. |
| Ambient | 26 |
| Screw shell (lamp holder body) | 106 |
| Lamp holder lead, ¼" from point of connection or live part of lamp holder | 89 |
| Outside housing 1" from bottom, on side nearest test box | 76 |
| Outside of housing 1" from bottom on side nearest test box | 53 |
| Outside of housing at top above filament | 78 |
| On side of junction box (inside), facing lamp at center | 59 |
| Plaster frame at opening 24, on metal facing wood | 56 |
| Outside of housing, in line with lamp filament on side nearest lamp | 76 |
| Through wire conductor | 75 |
| Through wire insulation | 74 |
| Ballast core on side facing socket | 102 |
| Ballast winding facing socket | 102 |

Based on these test results, it was determined that the recessed lighting fixture embodying features of the present invention was found to comply with UL 1570 standards.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departing from the spirit of the invention as described in the following claims.

What is claimed is:

1. A recessed lighting fixture for installation in a space over a ceiling, comprising:

a housing with an opening in one end for passage of light;

means for mounting the housing above the ceiling having an opening for passage for light from the housing into the space below the ceiling;

a socket attached to the housing for receiving a lamp for emitting light through the opening in the housing;

a ballast having sides, a support end having at least one tab for securing the ballast to the housing, and a distal end, the ballast providing resistance to stabilize an electrical current communicated during operation of the lighting fixture from a source of electricity to the lamp received in the socket; and an insulative casing that encloses the sides and distal end of the ballast, whereby the insulative casing restricts the communication of heat from the lamp to the ballast during operation of the fixture.

2. The recessed lighting fixture as recited in claim 1, wherein the insulative casing comprises:

an insulative bag having an open end slidingly received on the ballast to blanket the sides and the distal end of the ballast; and a banding tape wrapped tightly around the open end of the insulative bag adjacent the support end of the ballast substantially closing the open end of the bag, whereby the ballast, being blanketed within the substantially closed insulative bag, does not become excessively heated by thermal communication with heat generated by the lamp during operation of the lighting fixture.

3. The recessed lighting fixture as recited in claim 1, wherein the insulative bag comprises a layer of fiberglass fibers and a film cover.

4. The recessed lighting fixture as recited in claim 3, wherein the film cover is a metallic foil.

5. The recessed lighting fixture as recited in claim 1, wherein the insulative casing comprises:

an open-ended rigid-wall container that slidingly receives the ballast; and an insulative material filling a gap between an inner surface of the container and the ballast.

6. The recessed lighting fixture as recited in claim 5, wherein the insulative material is polyurethane foam.

7. The recessed lighting fixture as recited in claim 1, further comprising a plate disposed between the socket and the ballast, the plate rigidly attached by a flange at one end to the housing to provide a barrier between the socket and the ballast, whereby heat generated by the lamp during operation of the lighting fixture is blocked from being communicated readily to the ballast.

8. A method of reducing thermal communication from a lamp to a ballast in a recessed lighting fixture for installation in a space over a ceiling, comprising the steps of:

(a) slidingly covering a ballast having sides, a support end, and a distal end, with an insulative casing to enclose the sides and the distal end of the ballast, the ballast providing resistance to stabilize an electrical current communicated during operation of the lighting fixture from a source of electricity to the lamp received in a socket mounted in the recessed lighting fixture; and (b) rigidly mounting the enclosed ballast in the housing spaced-apart from the socket for receiving the lamp that during operation generates both heat and light that emits through an open end of the housing into the space below the ceiling, whereby the ballast, being enclosed with the insulative casing, does not become excessively heated by communication of heat generated by the lamp during operation of the lighting fixture.

9. The method as recited in claim 8 wherein step (a) comprises:

enclosing the ballast within an insulative bag having an open-end to blanket the sides and distal end of the ballast; and wrapping a banding tape tightly around the open end of the insulative bag adjacent the support end of the ballast to substantially close the open end of the bag.

10. The method as recited in claim 8 wherein step (a) comprises:

enclosing a ballast within an open-ended rigid-wall container; and filling a gap between the ballast and sides of a container with insulative fill material.

11. The method as recited in claim 8, further comprising a step (c) of blocking heat generated by the lamp held in the socket from being communicated readily to the ballast by a plate having a sidewall and a flange, the plate disposed between the socket and the ballast and attached by the flange to the housing, and the sidewall extending from the flange providing a deflection barrier between the lamp in the socket and the ballast.

12. A recessed lighting fixture for installation in a space over a ceiling, comprising a housing having an open end with a socket attached within said housing for receiving a fluorescent lamp, said socket connected for electrical communication with a supply of electricity through a ballast mounted in said housing, said ballast having sides, a first end, and a second end, said ballast providing resistance for stabilizing a current communicated from said supply of electricity to said fluorescent lamp received in said socket, and means for mounting said lighting fixture over the ceiling, the improvement comprising an insulative bag having a bottom and side walls extending therefrom slidingly received on said ballast to blanket said sides and said second end of said ballast, and a banding tape wrapped tightly around said side walls near the first end of the ballast, thereby securing said insulative bag to said ballast and substantially closing said insulative bag for restricting communication of heat from the lamp to the ballast during operation of said lighting fixture.

13. The recessed lighting fixture as recited in claim 12, wherein said insulative bag comprises a layer of fiberglass insulative fibers and a covering sheet.

14. The recessed lighting fixture as recited in claim 13, wherein said covering sheet is a metallic foil.

15. The recessed lighting fixture as recited in claim 12, the improvement further comprising a plate disposed between the socket and the ballast, and rigidly attached by a flange at one end to said housing, the plate providing a deflection barrier between the socket and the ballast, whereby heat generated by the lamp during operation of the light fixture is blocked from being communicated readily to the ballast.

* * * * *